US009174224B2

(12) United States Patent
Bartsch et al.

(10) Patent No.: US 9,174,224 B2
(45) Date of Patent: Nov. 3, 2015

(54) CONTINUOUSLY OPERATING CENTRIFUGE

(75) Inventors: Eckhard Bartsch, Evessen (DE); Hans-Heinrich Westendarp, Braunschweig (DE)

(73) Assignee: BMA Braunschweigische Maschinenbauanstalt AG (DE)

( * ) Notice: Subject to any disclaimer, the term of this patent is extended or adjusted under 35 U.S.C. 154(b) by 915 days.

(21) Appl. No.: 13/319,530

(22) PCT Filed: May 14, 2010

(86) PCT No.: PCT/EP2010/056655

§ 371 (c)(1), (2), (4) Date: Jan. 25, 2012

(87) PCT Pub. No.: WO2010/130828

PCT Pub. Date: Nov. 18, 2010

(65) Prior Publication Data

US 2012/0122650 A1 May 17, 2012

(30) Foreign Application Priority Data

May 15, 2009 (DE) ..... 10 2009 021 589

(51) Int. Cl.
*B04B 9/12* (2006.01)
*B04B 7/02* (2006.01)

(52) U.S. Cl.
CPC .... *B04B 9/12* (2013.01); *B04B 7/02* (2013.01)

(58) Field of Classification Search
CPC ..... B04B 9/12; B04B 7/02; B04B 3/00; B04B 11/02; F16C 27/08
USPC ..... 494/82; 127/19, 56
See application file for complete search history.

(56) References Cited

U.S. PATENT DOCUMENTS

| | | | | |
|---|---|---|---|---|
| 4,022,375 | A | 5/1977 | Suovaniemi et al. | |
| 4,033,879 | A * | 7/1977 | Natt et al. | 210/369 |
| 4,063,959 | A * | 12/1977 | Dietzel et al. | 127/19 |
| 4,079,882 | A * | 3/1978 | Mizuyoshi et al. | 494/60 |
| 5,618,352 | A | 4/1997 | Ebeling et al. | |
| 2007/0225143 | A1 * | 9/2007 | Kim et al. | 494/82 |

FOREIGN PATENT DOCUMENTS

| | | |
|---|---|---|
| CN | 2 099 617 | 3/1992 |
| DE | 14 10 967 | 10/1968 |
| EP | 0 487 780 B1 | 6/1992 |
| EP | 0 692 311 | 1/1996 |
| EP | 0 733 406 B1 | 9/1996 |
| GB | 946244 | 1/1964 |
| GB | 2 115 319 | 9/1983 |
| JP | 2007 090325 | 4/2007 |

* cited by examiner

*Primary Examiner* — Charles Cooley
*Assistant Examiner* — Marc C Howell
(74) *Attorney, Agent, or Firm* — Salter & Michaelson

(57) ABSTRACT

A continuously operating centrifuge serves for centrifuging sugar massecuites. It has elements (20, 30, 40, 50) which rotate about a common axis (16). Furthermore, there is provided a drive unit (70), an outer housing incorporating a framework (10) having a base (11) and side walls (12) and vibration damping elements (82). An inner housing (80) is provided around the elements (20, 30, 40, 50) rotating about the common axis (16). The vibration damping elements (82) are arranged between the inner housing (80) and the base (11) of the framework (10) of the outer housing.

14 Claims, 3 Drawing Sheets

CONTINUOUSLY OPERATING CENTRIFUGE

TECHNICAL FIELD

The invention relates to a centrifuge for centrifuging sugar massecuites comprising elements which rotate about a common axis, a drive unit, an outer housing consisting of a framework having a base and side walls and vibration damping elements.

BACKGROUND OF THE INVENTION

There are many different forms of centrifuge. Thus, DE 14 10 967 A1 describes a drum which rotates about a vertical axis in a cylindrical container for use especially in washing machines. The laundry drum is emptied after each washing process and is then refilled in order to accomplish a new washing process. This centrifuge is thus operated in batch mode. The container with the laundry drum is suspended in a fixed housing which rests on the ground. In order to prevent the container from rotating, several strips project downwardly into several corresponding anti-rotation means which also produce a damping effect upon the vibrations produced by the rotating laundry drum.

From U.S. Pat. No. 4,022,375, there is known a laboratory centrifuge in which an arm having a plurality of test tubes affixed thereto circulates at high speeds of 4,000 to 12,000 revolutions per minute about a vertical axis in a cylindrical protective cover. After a centrifuging process, the test tubes are exchanged; this centrifuge is thus driven in a batch operational, mode. The laboratory centrifuge comprises a drive motor. The drive motor and the protective cover are mounted on a common platform which rests on resilient elements in a housing.

Centrifuges operating in a batch mode are unsuitable for numerous processes in which continuous operation is necessary or at least desired, perhaps with a view to maintaining a continuous supply of the raw materials that are to be treated in the centrifuge or for the continuous further processing of the intermediate products delivered by the centrifuge. On the other hand, continuous operation imposes completely different boundary constraints compared with a batch operation. Thus, vibrations occurring in a batch operation automatically come to a complete stop when the load is changed. They thus only have to be damped on a temporary basis, whereas in the case of a continuous centrifuge operation the vibrations occur permanently and consequently they must constantly be taken into consideration. In consequence, the damping concepts utilised in a batch operation process cannot be simply transferred over.

Other forms of centrifuge are known from GB 2 115 319 A for example. Liquids are processed in this centrifuge in which a motor is arranged above the centrifuge and is damped below relative to the centrifuge by means of shock-absorbent mounts. Such a centrifuge is not intended nor is it suitable for centrifuging sugar massecuites.

Continuously operating centrifuges such as are known from EP 0 487 780 B1 and EP 0 733 406 B1 for instance are used in the sugar industry. Such types of centrifuge, which are also referred to as sugar centrifuges or in the case of continuously operating centrifuges by the catch words continuous centrifuges, can be employed in the cane sugar and sugar beet industries as well as in sugar refineries. They serve to mix, to distribute and to accelerate the sugar massecuites being supplied thereto and thereby free them from foreign entities such as by means of a washing process involving the addition of water or steam.

The centrifuges stand on a suitably firm base in the factory buildings. The centrifuge drums rotate at very high speeds in order to enable them to cope with their task. To this end in particular, they are driven by a drive unit incorporating a motor utilising an endless drive means. The centrifuge drums rotate about a vertical axis and, as a rule, have an upwardly flaring conical sieve basket which forms a discharge edge.

The centrifuge drum has a mounting means. Since the vibrations of the centrifuge drum are not insignificant due to the unavoidable imbalances which occur at the high rotational speeds involved, these vibrations must not to be passed on to the environment. A means for damping the vibration of the centrifuge drum with respect to its environment is thus desired.

It is known to place the complete centrifuge together with its outer housing on vibration damping mounts, namely, on three or more elastomers.

This has the disadvantage that the entire housing is still subjected to oscillatory forces and is prone to vibrate. It is of course the case that, due to the resilient vibration damping mountings between the base and the housing, these vibrations are not transferred to the base—or are merely damped in the transfer process, but on the other hand, the correspondingly vibrating and moving outer housing of the centrifuge imposes permanent and continuous acoustic and mechanical burden on the environment, the latter difficulty also applying for the various connections since both the electrical connectors and the input leads and the supply elements are either mechanically loaded insofar as they are connected to the outer housing or else materials cannot be supplied and removed in a reliable or constantly adequate manner or the lines that are utilised for this purpose cannot be fed-in close to the centrifuge due to the movements of the elements with respect to one another.

In another state of the art, the centrifuge drum itself is mounted inside the housing in a manner such that it is vibration damped with respect to the directly adjacent parts. The problems which ensue in the case where the entire centrifuge including the outer housing is mounted in vibration-isolating manner can then indeed be avoided, but against that, the maintenance of such a conception wherein she vibration-damping mounting is merely in respect of the centrifuge drum is problematic. The vibration damping elements are now located in certain locations in the interior of a complicated assembly so which it is difficult to gain access and they can then only be maintained by specialists. Hereby, it has to be taken into consideration that the elastomers that are being used here are under a considerable load due to the high rotational speeds as a result of the high frequencies on the one hand and as a result of the continuous operational state on the other and they must therefore be replaced considerably more frequently whereby appropriate maintenance measures are necessary, and not just in a special case. In addition, this is a completely different situation from that of laboratory centrifuges or washing machines for instance, since these are only being used as and when necessary and in batch-like manner.

Moreover, it also has to be taken into consideration that the vibration damping elements in the vicinity of the centrifuge drum in the interior of the entire sugar centrifuge are now in a region which is exposed to very high temperatures since it is precisely here in the vicinity of the drum where the heating region is located in sugar centrifuges. As a result of this additional loading, the vibration damping elements which are frequently in the form of rubber buffers have to be additionally replaced on a still more frequent basis in order for them to be able to fulfil their proper function. Furthermore, there are high mechanical loads on the drive unit whereby vibrations of comparatively large amplitude occur between the drum axis and the motor.

It would be desirable co produce a vibration camping system for sugar centrifuges which is effective and maintenance-friendly at the same time.

SUMMARY OF THE INVENTION

The object of the invention is to propose such a centrifuge.

In accordance with the invention, this object is achieved in the case of a centrifuge of the type mentioned hereinabove in that an inner housing is provided around the elements rotating about the common axis, in that the vibration damping elements are arranged between the inner housing and the base of the framework of the outer housing, in that the drive unit together with the inner housing are vibration-damped by the vibration damping elements with respect to the outer housing incorporating the framework, and in that there is provided a surrounding collecting device for the centrifuged sugar particles which is vibration-damped together with the outer housing incorporating the framework with respect to the inner housing.

Such an invention results in a particularly continuous centrifuge which is especially suitable for the sugar industry and which comprises centrifuge drums and further rotating elements such as product distributors for instance, wherein the process of damping the vibration of the centrifuge drum is implemented in such a manner that an inner housing and also the entire drive unit including a motor are also isolated from vibrations together with the centrifuge drum.

Thus, this vibration isolation process is then effective for the outer region of the centrifuge comprising the outer housing and the collector region for the separated sugar.

Considerable advantages thereby ensue. The outer housing of the sugar centrifuge is already part of the vibration-isolated region and so in this respect is part of the environment, and it is fixed with respect thereto. Consequently, the outer housing does not vibrate so that there are no problems for the connections and supply lines which lead to and from the exterior to the sugar centrifuge.

That is of direct importance for the regions which, for instance, serve for the conveyance of the centrifuged sugar particles from the collecting device. Here for instance, one can conceive of conveyor belts or other conveyer systems which, in accordance with the invention, are completely decoupled from the vibrations of the centrifuge and also from those of the drive unit and which are consequently no longer subject to problems that relate to the process of conveyance out of the entire plant and the connection to further assemblies for instance. There is thus no longer any danger of plug-in connections, couplings, interface elements etc. becoming disconnected (because they are vibrating).

However, those regions which are producing the vibrations or which are themselves vibrating such as the drive unit comprising the motor and also the rotating centrifuge drum for instance, are vibration-isolated as a whole with respect to the environment, namely, in common with one another. All the vibrations that are being produced and developed are thus taken into consideration by the vibration isolating process.

Nevertheless, a simple maintenance process can be effected via the selected interface since the vibration isolating process is being provided at a location that is completely exterior to the mechanically moving and moved elements.

The centrifuge drum together with the product distributor, the drive unit incorporating the motor and the entire inner housing are thus mounted in vibration isolating manner with respect to the outer housing and the environment. This thus preferably results in an arrangement of the parts chat are to be damped at a defined number of positions in which the vibration-isolating elements are positioned. There are three to six such positions.

These three to six positions are preferably located in the corner points of the centrifuge housing and under the motor that is preferably disposed in the rear region. Further positions would preferably be symmetrical relative to the centre of the centrifuge with respect to the places located in the front region.

Outside the vibration-isolated region, lies the totality of the collecting region for the separated sugar which has been centrifuged outwardly by the centrifuge drum wherein it is collected and conveyed away for further treatment. Likewise located outside the vibration-isolated region, are the entire outer housing of the centrifuge, the electrical connections, the operating elements and further components which do not themselves produce vibrations.

Preferably, provision is made for the surrounding collecting device for the centrifuged sugar particles to comprise a surrounding cylindrical wall and preferably an adjoining peripheral channel which lies within this wall and is fixed to the wall.

The wall can be fixed directly to the outer housing for example, to its upper surface for instance, and/or extend vertically downwardly therefrom.

Alternatively, the channel could also be replaced by a surrounding device which is not fixed to the cylindrical wall but which is located near the base for example, said device incorporating a conveyor device for immediately conveying the captured sugar particles of for further treatment. These devices too would then be protected or damped from the vibrations caused by the rotation of the centrifuge.

The interfaces between the inner centrifuge housing that is mounted in vibration-isolating manner and the outer centrifuge housing that is firmly fixed to the base are installed above the mounting feet and sealed with a flexible material.

It is particularly preferred, that the centrifuge housing be now in the form of a square. Conventionally, continuous centrifuges are provided instead with a circular or cylindrical housing which is predetermined by the rotation of the sieve drum. The motor and the drive unit are then provided beside the round housing.

In accordance with the invention however, this expediently results in a square surface area whereby four of the positions for the vibration isolating process are located in the corners of the square and, in this way, they are particularly easily accessible. In addition, another two positions for the mounting points can be provided, these serving for the mounting of the drive unit. In addition to the square surface area for the centrifuge, this is complemented by a further region which can be taken into consideration by the addition of a rectangular surface.

A further advantage of the square (or rectangular) concept is that when a plurality of centrifuges are set up next to one another, a closed front can be obtained, this thereby leading to an easily cleanable plant which is also easy to keep clean.

To be taken into consideration here, is that there is a very frequent need for a whole set of sugar centrifuges in a sugar factory, these sometimes being operated in parallel with one another in order to increase the processing capacity. In the case of the conventional arrangement of a plurality of cylindrical centrifuge housings having external motors, this results in a very large number of small angular gaps which are extremely difficult to access and laborious to clean. In addition, cylindrical sugar centrifuges are set up in a space-saving manner in order to enable the space available in the building housing the sugar factory to be used effectively so that a narrow and multi-cornered set-up of this type is provided in the state of the art.

Due to the square shape or possibly rectangular shape or even perhaps a hexagonal honeycomb-like ground plan structure of the outer housing of a sugar centrifuge however, it is possible to produce a neighbouring arrangement without gaps so that the question of cleaning narrow multi-cornered regions no longer arises. The housings of neighbouring sugar centrifuges can also be constructed in such a manner that they can be cleaned from the exterior in a very simple and practically seamless manner.

Further preferred features are indicated in the appendant Claims.

DESCRIPTION OF THE DRAWINGS

An exemplary embodiment of the invention is described in more detail hereinafter with the aid of the drawing. Therein.

DETAILED DESCRIPTION

Figure 1:
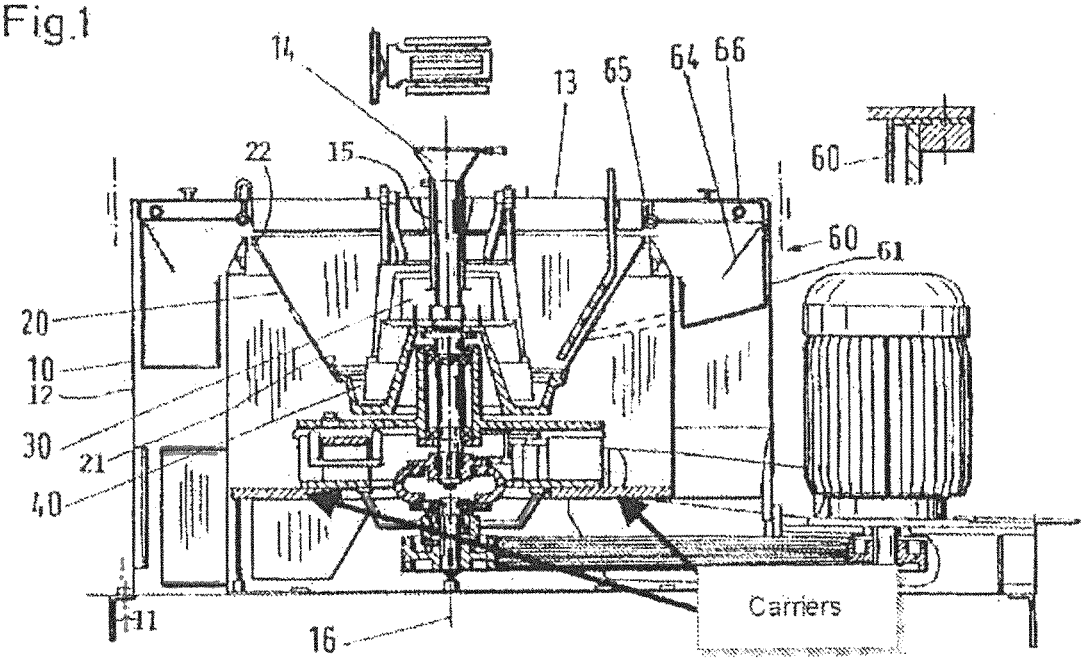
FIG. 1 shows a perspective, partly sectional illustration of an embodiment of the invention.

The centrifuge illustrated in FIG. 1 serves for centrifuging sugar massecuites in order to initially separate out the mother solution from a so-called magma in the course of a multi-step treatment and then to clean the sugar crystals released from the mother solution of any remaining impurities.

The centrifuge consists of a static framework 10 having a base 11, side walls 12, a cover 13 and a filler funnel 14. Sugar massecuite is fed through the filler funnel 14 into a shaft 15. The filler funnel 14 and the shaft. 15 are also static.

Also clearly apparent to the observer, is a sieve basket 20 which extends, from below, nearly up to the cover 13 in the upper region of the centrifuge. The sieve basket. 20 is axially symmetrical about a vertical axis 16 and widens out conically from the bottom in the upward direction. The sugar particles migrate upwardly on the inner wall of this sieve basket 20 during the relatively rapid rotation of the sieve basket 20 and are then spun-off outwardly at the upper rim 22 of the sieve basket 20.

After being spun off from the upper rim 22 of the sieve basket 20, the centrifuged sugar particles strike a surrounding vertical wall 17 and from there, they fall into a channel 18 which is connected to the wall 17 and is likewise arranged entirely around the sieve basket 20. The captured sugar crystals are then conveyed away from the channel 18 for further processing.

In this exemplary embodiment, the wall 17 together with the channel 18 form a collecting device 19. The wall 17 adjoins the cover 13 of the outer housing comprising the framework 10 and is connected thereto. The channel 18 projects inwardly from the surrounding wall 17 of the collecting device 19 towards the sieve basket 20 but touches neither it nor the elements connected thereto.

Before the sugar massecuites reach the inner wall of the sieve basket 20 from the shaft 15, they fall into a distributor pot 30 and from there, they enter a product distributor 40. In the illustrated embodiment, the product distributor 40 is equipped with an additional bell 50 and consists of several ring elements. The sieve basket 20, the distributor pot 30 and the product distributor 40 and also the bell 50 in the illustrated example rotate about a common vertical axis 16 which also represents the axis of the non-rotating shaft 15 at the same time.

Moreover, the product distributor 40 and the distributor pot 30 are connected to one another and rotate together.

The drive for the rotation of the sieve basket 20, the distributor pot 30, the product distributor 40 and the bell 50 is effected by a drive unit 70. In particular, the drive unit 70 comprises a motor. The drive unit 70 is connected by (not illustrated) drive belts or other transmission devices to the sieve basket 20 and the other rotating devices and enables them to rotate about the axis 16.

The rotating parts of the centrifuge and, in like manner, the drive unit 70 implement movements which inevitably lead to vibrations in these components. These vibrations are also passed on to neighbouring components.

Consequently, a mounting for the sieve basket 20 together with the additional elements rotating therewith is provided in a kind of inner housing 80. The inner housing 80 is drum-shaped and does not itself rotate therewith, but rather, it accommodates the rotating parts such as the sieve basket 20 for example. The mounting process is effected by means of mounting devices 81 which project outwardly from the inner housing 80. In the illustrated embodiment, there are four mounting devices 81 which are displaced relative to each other by 90° as seen symmetrically about the vertical axis 16.

The inner housing 80 itself is bounded downwardly by a base plate 84 which also runs underneath the sieve basket 20.

The inner housing 80 does not touch the channel 18 nor the wall 17 of the collecting device 19.

Since FIG. 1 is partially sectional, two of the mounting devices 81 can be seen to the left and the right of the cut-away quarter of the centrifuge; for the observer, the third mounting device 81 would lie directly in the cut-away region, the fourth mounting device 81 being diametrically behind the sieve basket 20 or the centrifuge drum.

The our mounting devices 81 are each separated from the base 11 of the housing or framework 10 by means of vibration damping elements 82. This means that the rotating parts in their entirety are not connected so the base 11 of the framework 10 of the outer housing in vibration-transferring manner, but rather, chat the vibrations of these rotating parts are not in fact transferred to the outer housing.

The drum-shaped inner housing 80 thus has a substantially vertically-extending wall which is surrounded coaxially on the outer side thereof by the wall 17 and the channel 18. The wall 17 and the channel 18 of the collecting device 19 are connected to the upper cover 13 of the framework 10 and thus appertain to the outer housing in regard to the vibration isolating process. Since these elements 17, 18, 19, 13 neither rotate nor are otherwise subject to vibrations, they are those which are fully isolated from vibration with respect to the directly neighbouring rotary elements 20, 30, 40, 50 and their mounting in the inner housing 80.

As one can likewise very clearly perceive from FIG. 1, the framework 10 with four side walls 12 is built up in such a way that the base 11 has a square horizontal projection. The sieve basket 20 and the other elements of the centrifuge drum together with the inner housing 80 are arranged centrally on this square horizontal projection of the base 11 and the four mounting devices 81 jut out precisely into the corners of the square horizontal projection of the base 11. There, they and also the vibration damping elements 82 not only have sufficient space, but they are also very easily accessible since they are not interfered with by other assemblies in this area. This layout considerably enhances the access to and the replacement of the vibration damping elements 82 in addition to the measures required for maintenance and checking purposes.

In order to simplify the maintenance work on the vibration damping elements 82, the side walls 12 of the framework 10 of the outer housing are entirely or partly removable. In FIG. 1 they are illustrated as being transparent in order to permit a view of the elements located behind them; in practice, they are metallic side walls 12.

Figure 2:
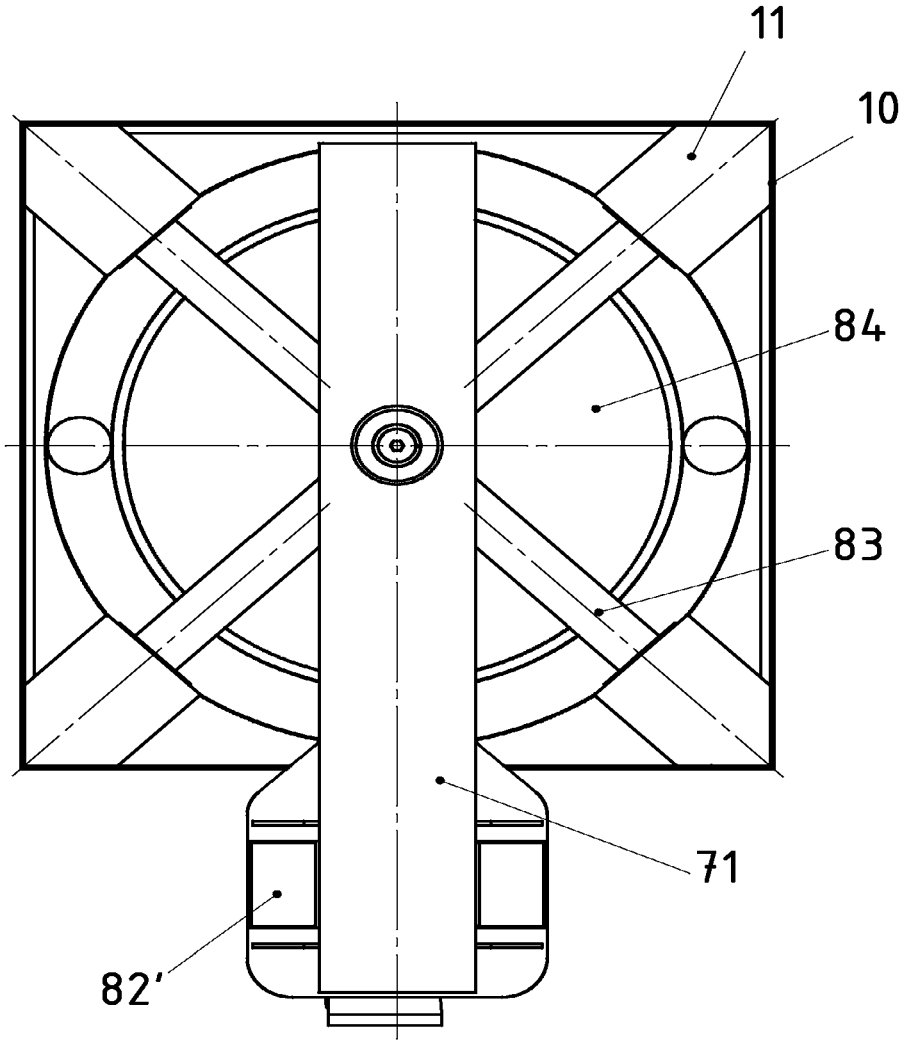
FIG. 2 a view of the embodiment depicted in FIG. 1 from below.

The embodiment of FIG. 1 is illustrated from below in FIG. 2. One can clearly see the square profile of the base 11, in which the centrifuge drum together with the sieve basket 20 that is not visible to the observer is located in the form of a circle as are the further rotary elements which cannot however be seen here since they are concealed by the base plate 84 of the inner housing 80.

Underneath the centrifuge drum and thus for the observer in from of the base plate 84 in this illustration from below, are the mounting devices 81 which are displayed in the form of outer ends of horizontally extending carriers 83 which lead outwardly from the vertical axis 16 in this illustration.

The vibration damping elements 82, upon which the outer ends of the carriers 83 i.e. the mounting devices 81 bear, are concealed by plate-like reinforcements of the base 11.

Furthermore, one can see a support device 71 which connects the drive unit 70 to the carriers 83, said drive unit not being visible to the observer here. In this way, the drive unit 70 is also vibration-damped with respect to its surroundings by means of the support device and the carriers 83 on the vibration damping elements 82. Additional vibration damping elements 82' are located under the drive unit 70.

Figure 3:
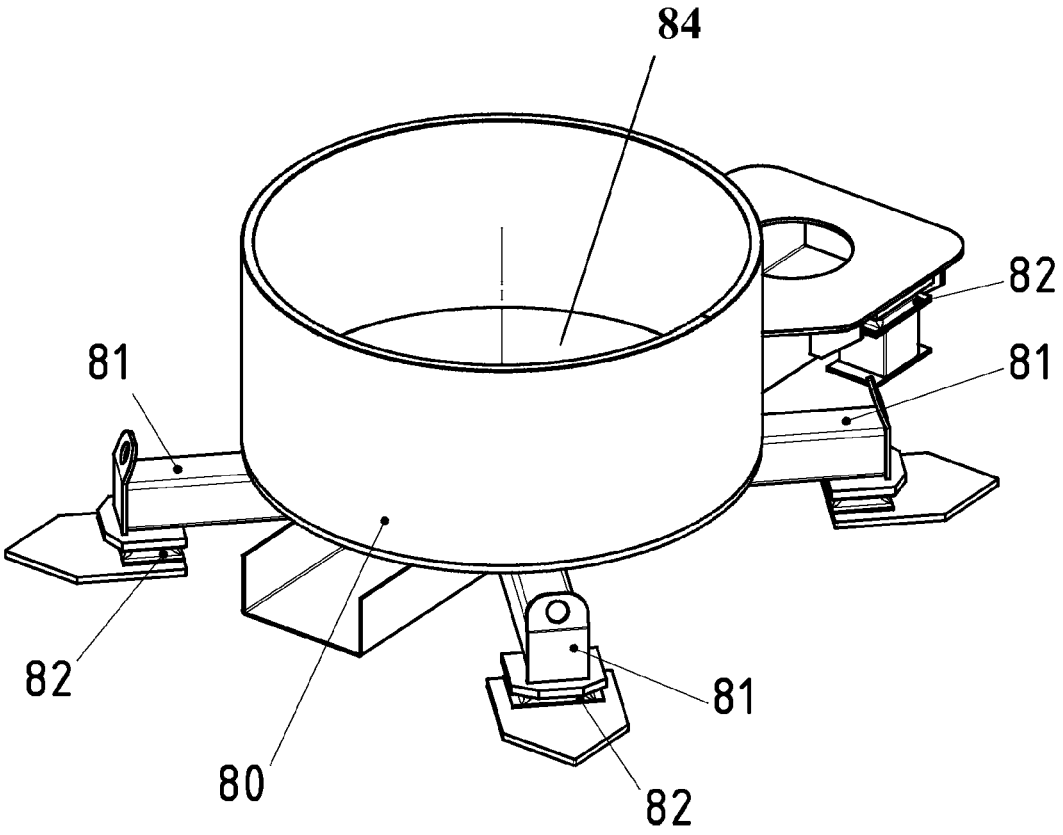
FIG. 3 a separate illustration of some of the elements in the embodiment depicted in FIG. 1.

Just part of a centrifuge in accordance with the invention omitting further components thereof is now illustrated in FIG. 3. The outer housing comprising the framework 10 and also the functional parts such as the sieve basket 20, the distributor pot 30, the product distributor 40 and the bell 50 for instance have been omitted from FIG. 3. Instead, one can see the inner housing 80 together with the outwardly protruding mounting devices 81 and the vibration damping elements 82 that are indicated therebelow.

Within the inner housing 80, there is illustrated a cylindrical component which carries the sieve basket and those other elements that are not illustrated. One can therefore perceive the base plate 84.

Furthermore in FIG. 3, one can see the plate which can be regarded as an extension of the support device 71 and which carries the drive unit 70 (this itself not being illustrated here).

In addition in this enlarged illustration of FIG. 3, one can again readily perceive how easy it is to maintain the vibration damping elements 82 which are accessible from the exterior without having to delve into the inner, complex part of the rotating components. At the same time, these damping elements 82 are disposed in a region which is less hot than the region inside the inner housing 80.

On the other hand, it is also clear that all of the connections to the outer housing and also the entire collecting region for the separated sugar between the inner housing 80 and the framework 10 of the outer housing are already isolated from vibrations and consequently no longer move with respect to the surroundings. Consequently, there are no problems with external plug connectors to the sugar centrifuge and in addition there is no acoustic disturbance to the environment due to vibrating parts of the housing.

Since the axis 16 of the drum does not move or swing relative to the axis of the drive unit 70 in the described construction of the centrifuge in accordance with the invention, the appertaining elements are protected accordingly. Consequently, costly strain relieving means such as are described in EP 0 733 406 B1 for example are no longer needed.

LIST OF REFERENCE SYMBOLS

10 fixed framework
11 base of the framework
12 side walls of the framework
13 cover of the framework
14 filler funnel
15 shaft
16 vertical line of the axis
17 wall
18 channel
19 collecting device
20 sieve basket
22 upper rim of the sieve basket
30 distributor pot
40 product distributor
50 bell
70 drive unit
71 support device
80 inner housing
81 mounting devices
82 vibration damping elements
82' vibration damping elements
83 carrier
84 base plate

What is claimed is:

1. A continuously operating centrifuge for centrifuging sugar massecuites, comprising, members which rotate about a common axis and including at least a basket for receiving the sugar massecuites, a drive unit, an outer housing including a framework having a base and side walls, a plurality of vibration damping elements, an inner housing which is provided around the members, and including a base plate and an annular side wall, wherein each vibration damping element is arranged between the inner housing and the base of the framework of the outer housing, wherein the drive unit together with the inner housing are vibration-damped with respect to the outer housing, and wherein there is provided a surrounding collecting device for the centrifuged sugar particles which together with the outer housing incorporating the framework is vibration-damped with respect to the inner housing, a plurality of mounting devices including separately disposed elongated carriers that each extend radially outwardly from the common axis below the inner housing and which each have a distal end which projects beyond the annular side wall of the inner housing, wherein each vibration damping element is disposed between the distal end of a respective carrier and the base of the outer housing so that any vibrations generated by the rotating members are not transferred to the outer housing, wherein all of the vibration damping elements are located entirely outside of the annular side wall of the inner housing and between the annular side wall of the inner housing and the side wall of the outer housing so that the vibration damping elements are accessible for maintenance or replacement thereof.

2. A continuously operating centrifuge in accordance with claim 1, characterized, in that four vibration damping elements are provided at different positions, and in that the separately disposed elongated carriers extend in different radial directions.

3. A continuously operating centrifuge in accordance with claim 1, characterized, in that the outer housing incorporating the framework has a base with a square surface area, and in that the vibration damping element and the mounting device are arranged in respective corners of the square surface area between the inner housing and the side walls of the outer housing.

4. A continuously operating centrifuge in accordance with claim 1, characterized, in that one of the vibration damping elements is arranged under the drive unit.

5. A continuously operating centrifuge in accordance with claim 1, characterized, in that the vibration damping element is formed by rubber buffers.

6. A continuously operating centrifuge in accordance with claim 1, characterized, in that the surrounding collecting device for the centrifuged sugar particles comprises a surrounding cylindrical wall and an adjoining peripheral channel which is disposed within this wall and is fixed to the cylindrical wall.

7. A continuously operating centrifuge for centrifuging sugar particles, comprising:

an outer stationary housing including a base and side walls;

a basket supported within the stationary housing and having an upper rim from which sugar particles spin outwardly from the basket;

a drive unit for rotating the basket about a vertical drive axis in order to spin off the sugar particles;

an inner stationary housing disposed coaxial with and within the outer stationary housing and for containing at least the basket therein;

said inner stationary housing including a base plate and an annular side wall, a collecting device disposed outboard of the basket rim and constructed and arranged for receiving the centrifuged sugar particles;

at least one mounting device disposed under the inner stationary housing for supporting the inner stationary housing over the base of the outer stationary housing;

at least one vibration damping element arranged between the mounting device and the base of the outer stationary housing;

wherein the inner stationary housing is vibration-damped with respect to the outer stationary housing by the vibration damping element;

including a plurality of mounting devices and associated plurality of vibration damning elements, wherein each mounting device comprises a separately disposed elongated carrier, wherein the separately disposed elongated carriers each extend radially outwardly from the vertical drive axis and below the stationary inner housing, wherein each elongated carrier has a distal end that projects be and the station inner housing, and wherein each vibration damping element is arranged below the respective elongated carrier distal end and above the base of the outer housing so that vibrations generated by the rotating members are not transferred to the outer housing, and wherein all of the vibrating elements are located entirely outside of the annular side wall of the inner housing and between the annular side wall of the inner housing and the side wall of the outer housing so that the vibration damping elements are accessible for maintenance or replacement thereof.

8. A continuously operating centrifuge in accordance with claim 7 wherein the elongated carriers are arranged symmetrically under the inner stationary housing, each elongated carrier projecting radially outwardly from the vertical drive axis so that the distal ends of the carriers are in separate locations and extend in different radial directions.

9. A continuously operating centrifuge in accordance with claim 8 wherein each vibration damping element comprises a rubber buffer.

10. A continuously operating centrifuge in accordance with claim 8 wherein the base of the outer stationary housing is four-sided defining four corners of the base, a vibration damping element is disposed at the outer end of each elongated carrier, and each vibration damping element is arranged only at a respective corner of the base.

11. A continuously operating centrifuge in accordance with claim 7 wherein the stationary inner housing is drum-shaped with an upper peripheral edge positioned at a height of the upper rim of the basket.

12. The continuously operating centrifuge in accordance with claim 7 including a vibration damping element located under the drive unit.

13. The continuously operating centrifuge in accordance with claim 7 wherein the collecting device comprises a surrounding cylindrical wall and an adjoining peripheral channel which is disposed within the cylindrical wall and is fixed to the cylindrical wall.

14. The continuously operating centrifuge in accordance with claim 7 wherein the side walls of the outer housing include four side walls and the base of the outer stationary housing is four-sided, wherein the four side walls and the four-sided base together defining four respective right angle corners of the outer housing, wherein a right angle corner area is defined between each outer housing right angle corner and the annular outer wall of the inner housing, and wherein each vibration damping element is arranged only within a respective right angle corner area.

* * * * *